US007267031B1

(12) United States Patent
Burton et al.

(10) Patent No.: US 7,267,031 B1
(45) Date of Patent: Sep. 11, 2007

(54) BOTTLE CAP REMOVER

(75) Inventors: John Burton, Irvine, CA (US); Andrew Burton, Irvine, CA (US)

(73) Assignee: T Assist, Inc., Irvine, CA (US)

( * ) Notice: Subject to any disclaimer, the term of this patent is extended or adjusted under 35 U.S.C. 154(b) by 0 days.

(21) Appl. No.: 11/368,125

(22) Filed: Mar. 6, 2006

(51) Int. Cl.
*B67B 7/18* (2006.01)
*B67B 7/15* (2006.01)
*B67B 7/44* (2006.01)

(52) U.S. Cl. ..... 81/3.4; 81/3.09

(58) Field of Classification Search ..... 81/3.4, 81/3.41, 3.07, 3.09
See application file for complete search history.

(56) References Cited

U.S. PATENT DOCUMENTS 1,919,866 A * 7/1933 Schacht ..... 81/3.4
2,985,044 A * 5/1961 Gill ..... 81/3.4
3,730,025 A * 5/1973 Monnerjahn ..... 81/3.4
4,337,678 A * 7/1982 Mumford ..... 81/3.4
4,414,865 A * 11/1983 Brooks et al. ..... 81/3.09
4,433,597 A * 2/1984 Rowland ..... 81/3.09
D277,160 S * 1/1985 Antone ..... D8/40
4,507,988 A * 4/1985 LoFaso et al. ..... 81/3.09
4,723,465 A * 2/1988 Hughes ..... 81/3.09
4,760,763 A * 8/1988 Trick et al. ..... 81/3.09
4,911,038 A * 3/1990 Ferrin ..... 81/3.09
5,388,297 A * 2/1995 Ross ..... 7/156
6,105,468 A * 8/2000 Fohrman et al. ..... 81/3.09

FOREIGN PATENT DOCUMENTS

DE 4113167 A1 * 10/1992
WO WO8302265 A1 * 7/1983

* cited by examiner

*Primary Examiner*—David B Thomas
(74) *Attorney, Agent, or Firm*—Marvin N. Gordon

(57) ABSTRACT

A bottle cap remover includes a pair of axially nested socket sections of different diameters depending axially from a larger-diameter grasping section. Each of the socket sections includes frictional gripping members along their inner walls that are adapted to frictionally engage different sizes and types of metal and plastic bottle caps, thereby to enable the user to twist off and remove the bottle caps by applying a relatively small twisting force to the grasping section.

12 Claims, 3 Drawing Sheets

BOTTLE CAP REMOVER

BACKGROUND OF THE INVENTION

1. Field of the Invention

The present invention relates generally to the removal of closures from containers, and more particularly to a bottle cap remover that is capable of removing the caps from multiple kinds of bottles with a reduced twisting force.

2. Description of the Prior Art

Millions of people every day remove the twist-off caps from glass and plastic bottles of varying opening diameters by applying a manual twisting force to the screw-top bottle caps, thereby to remove the bottle caps and allow the liquid contents of the bottle, typically beer, juice or soda, to be poured out. For most individuals, the removal of a screw-top bottle cap can be usually achieved with relative ease by simply grasping the cap, typically with the thumb and middle finger of one hand, and rotating the cap in the counter-clockwise direction to unscrew and thus remove the cap from the bottle. On occasion, the cap may be so tightly secured to the container that even a healthy person of ordinary strength may have difficulty unscrewing the bottle cap without the use of a tool such as a wrench or pliers to provide a sufficient twisting force to remove the cap.

However, for the elderly and those who suffer from arthritis, for example, the removal of a screw-on bottle cap may on almost all occasions present an insuperable problem since persons so afflicted are often unable to grasp tightly and twist a bottle cap with a sufficiently large torsional force to remove the bottle cap bottle cap without pain or discomfort. As the population of elderly people in the United States continues to grow, the need for a device that would allow them to perform such a basic task as opening a bottle becomes more pressing. There thus exists a need for a device that would allow an individual who suffers from arthritis or who for any other reason is unable to grasp and twist a screwed-on bottle cap with a sufficient torsional force to readily remove the bottle cap without pain or discomfort and to do so with bottle caps of a wide variety of sizes and materials.

SUMMARY OF THE INVENTION

It is accordingly an object of the invention to provide a bottle cap remover that can be reliably and easily used by an individual whose physical limitations would otherwise prevent him or her from manually removing a bottle cap.

It is a further object of the present invention to provide a bottle cap remover that requires a lesser manual twisting force to remove bottle caps of varying sizes.

It is another object of the present invention to provide a bottle cap remover of the type described which allows the user to apply an increased torsional twist-off force than could be applied manually by the user.

To these ends, the bottle cap of the present invention comprises a knob-shaped grasping section which includes a plurality of semicircular or arcuate recesses spaced about its periphery for receiving the fingers of the user's hand, thereby to enable the user to firmly grasp the bottle cap. Extending axially from the central portion of the grasping section is a socket that includes at least two concentric and axially aligned socket sections each having a diameter that is less than that of the grasping section. One socket section includes a plurality of gripping elements adapted to firmly engage and grip metal crimped crown caps typically used on glass bottles. The other socket section has a diameter different than that of the first socket section and is preferably tapered to engage plastic twist caps of varying sizes. The latter socket section includes a second plurality of gripping elements that are designed and adapted to securely engage the multiple types of plastic twist-top caps used to close plastic beverage (e.g. soda) bottles.

In use, the socket is slipped over the top of a bottle to the extent required to place the appropriate socket section over the bottle cap so as to securely, frictionally engage the bottle cap. The user then places his or her fingers into the finger recesses of the grasping section, applies a slight downward pressure and gently twists or rotates it in a counter-clockwise direction, thereby to impart a relatively large twisting force to the bottle cap and allow the cap to be removed from the bottle.

In a further aspect of the invention, one of segments between the finger recesses in the grasping section may be linear rather than arcuate to accommodate a rectilinear slot that can be positioned over a tab closure to engage and lift the tab commonly found, for example, on soda cans.

To the accomplishment of the above and such further objects as may hereinafter appear, the present invention relates to an improved bottle cap remover, substantially as defined in the appended claims as considered in conjunction with the following detailed description of a preferred embodiment thereof along with the accompanying drawings in which:

DETAILED DESCRIPTION OF THE PREFERRED EMBODIMENT

Figure 1:
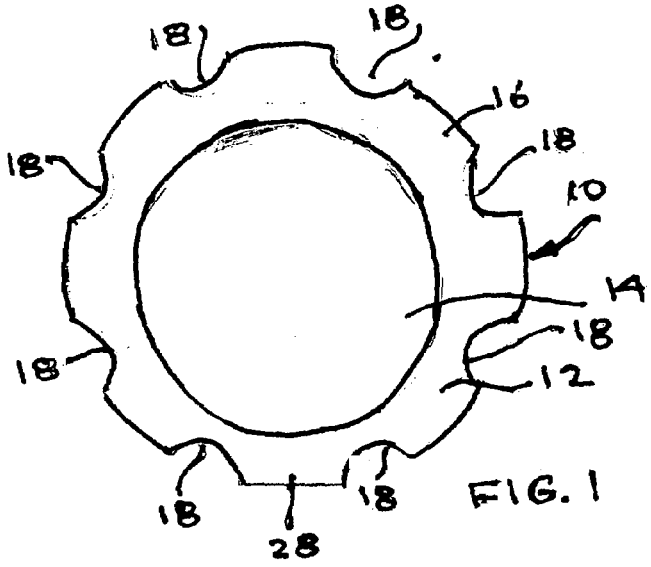
FIG. 1 is a top elevation of a bottle cap remover in accordance with a presently preferred embodiment of the invention.
Figure 2:
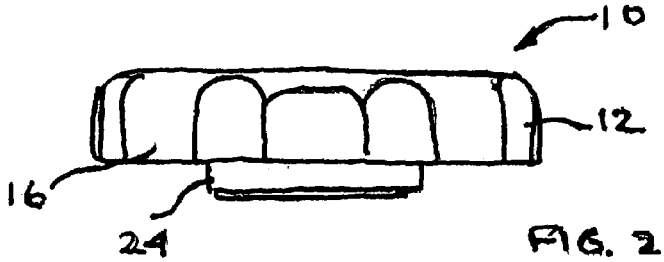
FIG. 2 is a side elevation of the bottle cap remover of FIG. 1.

Referring to the drawings, there is shown in FIG. 1 a bottle cap remover, generally designated 10 in accordance with a presently preferred embodiment of the invention. As therein shown, the bottle cap remover 10 is a unitary integral plastic piece made, for example, by injection molding using ABS plastic. The bottle cap opener 10 comprises a circular grasping section 12, which, as shown best in FIG. 1, has the appearance of a knob. Grasping section 12 includes a central, circular section 14 that may be slightly recessed (FIG. 4) to allow a label or the like to be secured thereto. Central section 14 is surrounded by a peripheral ring 16 that includes a plurality, here shown as eight in number, of arcuate or annular recesses 18, any five of which at a given time may receive the user's fingers when the bottle cap opener 10 is used as described in greater detail below.

Figure 3:
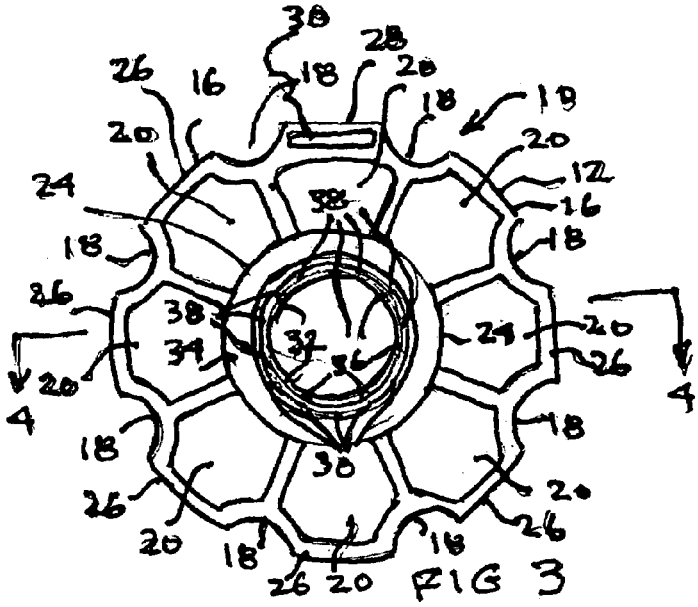
FIG. 3 is a bottom elevation of the bottle cap remover of FIG. 1.
Figure 5:
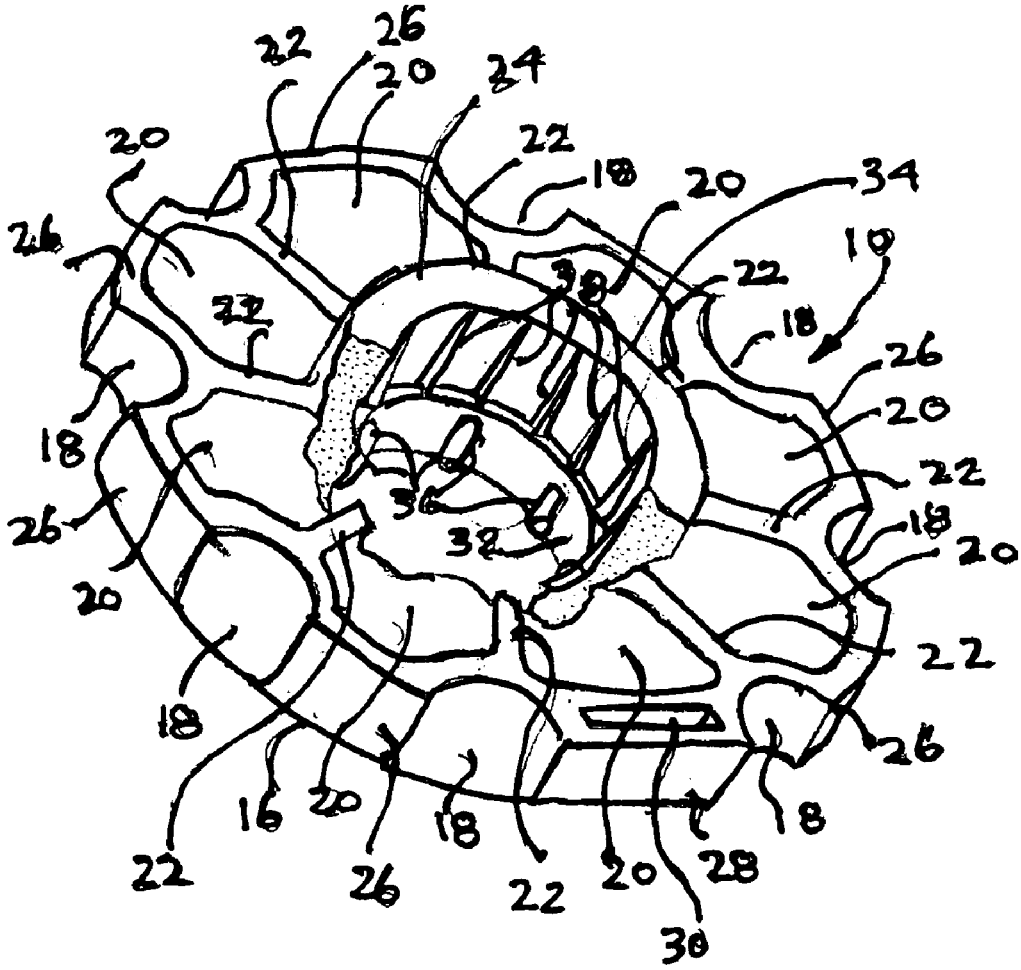
FIG. 5 is a perspective, partly broken away, of the bottle cap remover of FIG. 1.

Cutouts or hollowed-out portions 20*e* may be formed in the undersides of central section 14 and ring 16 to define, as seen best in FIG. 3, a plurality of radial strengthening ribs 22, each of which terminates at its inner ends at a central socket portion 24 that axially depends from the center of grasping section 12 and has a smaller diameter than that of section 12. As can be seen in FIGS. 1, 3 and 5, the outer segments 26 of ring 16 that extend between the arcuate recesses 18 are all slightly curved except for a peripheral segment 28, which, in contrast, is linear and includes an opening or narrow slit 30 (FIGS. 3 and 5) that can be used to lift the metal tab from the top of a soda can or the like.

Figure 4:
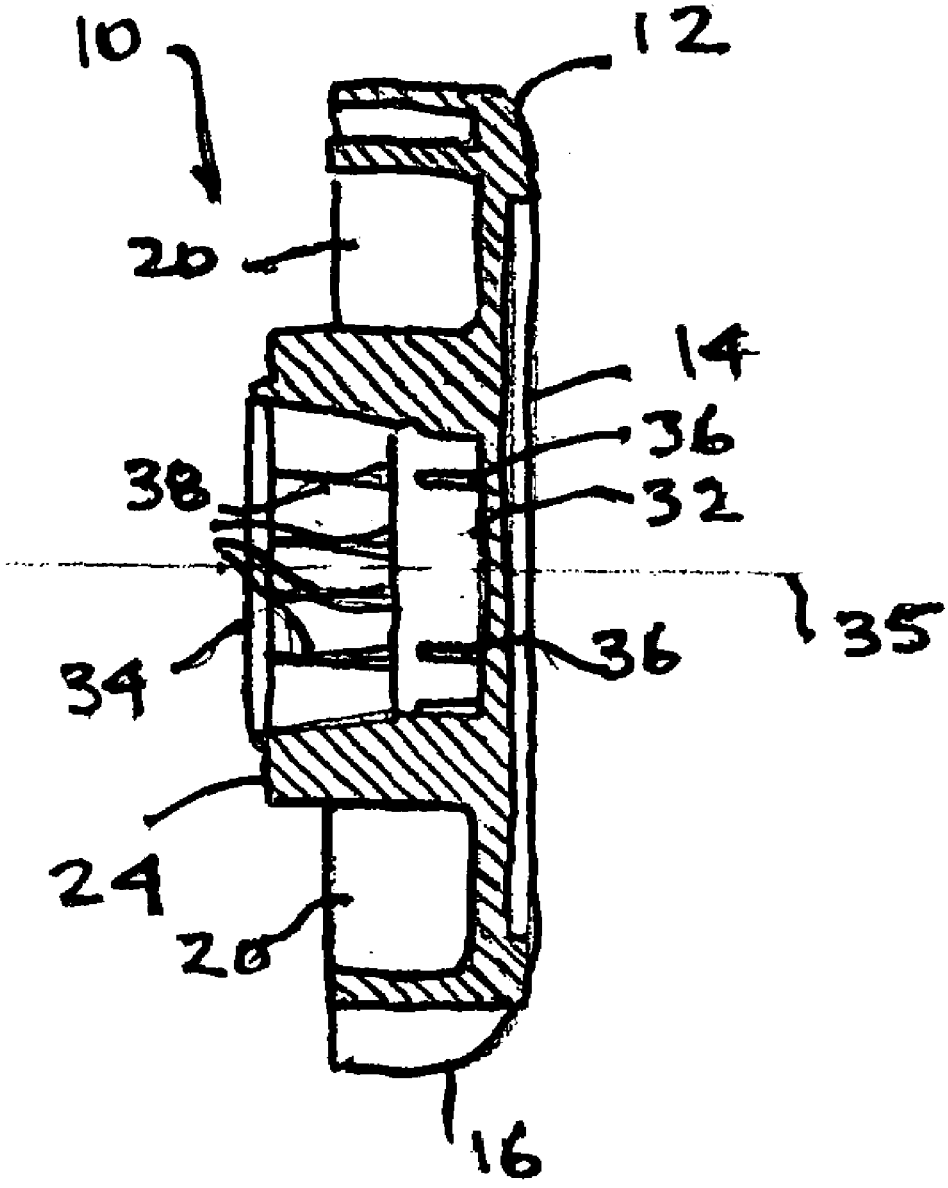
FIG. 4 is a cross-section taken in the direction of the arrows 4-4 in FIG. 3.

As can be seen most clearly in FIGS. 4 and 5, socket section 24 includes a first, inner socket section 32 and a nested, second, outer socket section 34, which are coaxial with respect to one another along the major axis 35 (FIG. 4) of the wider-diameter grasping section 12. The inner socket section 32 is cylindrical in shape and has a substantially constant diameter along its axial length. A plurality, here seven are shown, of semicircular splines 36 are spaced at substantially equiangular locations along the inner wall of inner socket section 32. Splines 36 are of a shape and size that are particularly adapted to securely, frictionally engage the peripheral, crimped edge of a conventional metal bottle cap.

The outer, second socket section 34 is of greater diameter than that of inner socket section 32 and tapers axially outward to a gradually increasing diameter. A plurality, here shown as fourteen in number, of V-form splines 38 are formed and equiangularly spaced along the inner, tapered wall of the second socket section 34, and are shaped, sized and positioned along this wall to permit the splines 38 to securely and frictionally engage the peripheries of conventional plastic twist-off caps of varying diameters.

As used herein, a spline is a raised segment that runs in a longitudinal/axial direction. The cross-section of the spline is preferably of a half-round or semi-circular form. The inner socket section 32, which includes the half-round splines 36 is designed to engage with the conventional twist-off, crimped metal cap (which typically includes 21 crimp segments). Since these caps are typically of a smaller diameter than the typical plastic twist-off caps, the bottles closed with metal caps will pass through the outer socket section 34. Outer socket section 34, which includes, as shown, fourteen V-shaped splines 38 is tapered so that splines 38 can engage the closure twist-off caps of a variety of conventional small-neck, plastic beverage bottles, such as half-pint, pint, half-liter, liter and two-liter containers. The diameters of these caps vary within a relatively narrow range and are slightly tapered, thereby to allow for a secure gripping engagement between the splines 38 and these caps, which are also typically too wide to pass into the inner socket section 32.

To use the bottle cap opener of the invention, an individual places the opener 10 over the bottle cap that is to be removed. Depending on the type and diameter of the bottle cap, it will be frictionally engaged by either the splines 38 of the outer socket section 34, or, for bottle caps of a smaller diameter, by the splines 36 provided along the inner wall of the inner socket section 32. The individual then places the fingers of one hand within five of the finger recesses of the upper grasping member 12, exerts a slight downward force on member 12 and then twists member 12 gently in a counter-clockwise direction until the bottle cap seal is broken and the cap is free from the bottle, and can be readily removed therefrom. The application of a relatively small twist-off force to the relatively large-diameter grasping section 12 is magnified to the lesser-diameter socket sections 32,34 one of which is at that time frictionally engaging the outer periphery of the bottle cap.

It will be appreciated from the foregoing description of a presently preferred embodiment thereof that the present invention, as described hereinabove, provides a bottle cap remover that can be used to remove a bottle cap with a reduced manual twist-off or torsional force, and is thus well suited for use by those having impaired manual strength. It will also be appreciated by those of ordinary skill in the art that modifications may be made to the embodiment specifically described above without necessarily departing from the spirit and scope of the invention.

What is claimed is:

1. A bottle cap remover comprising a grasping portion having a first diameter, a first cap-removing section coaxially depending from said grasping portion and having a second diameter less than that of said first diameter and that corresponds to the diameter of a first-sized bottle cap, and a second cap-removing section coaxially depending from said first cap-removing section and having an outwardly and downwardly tapering inner circumferential wall, said second cap-removing section having a continuously varying diameter greater than said second diameter and corresponding to a range of bottle cap sizes, the inner walls of said second cap-removing section including a plurality of axial splines or ribs which are tapered to a greater degree than the wall of said second cap-removing section, said splines or ribs having a cross-section that varies from a vee-shaped form at the largest diameter portion of said second cap-removing section to a half-round or semi-circular form at the smallest diameter portion of said second cap-removing section for frictionally and mechanically engaging the peripheries of said range of bottle caps.

2. The bottle cap remover of claim 1, in which a second plurality of splines or ribs are provided along the inner wall of said first cap-removing section.

3. The bottle cap opener of claim 2, in which said plurality of vee-shaped tapered splines or ribs are joined are joined in a colinear form, and wherein said plurality of splines or ribs which are half-round or semi-circular are joined to said vee-shaped splines in the form of a partial dome.

4. The bottle cap remover of claim 1, in which said grasping portion includes a plurality of arcuate recesses formed about its periphery for receiving a user's fingers.

5. The bottle cap remover of claim 1, in which said plurality of vee-shaped tapered splines or ribs are joined in a colinear form, and wherein said plurality of splines or ribs which are half-round or semi-circular are joined to said vee-shaped splines in the form of a partial dome.

6. The bottle cap opener of claim 1, in which a plurality of peripheral segments are defined intermediate said arcuate recesses of said grasping portion, and wherein a slot of rectangular cross-section is formed in at least one of said peripheral segments for engaging the closure tab of a can, said slot including a tapered wall to mechanically aid in the lifting of the closure tab.

7. A bottle cap remover comprising a grasping portion having a first diameter and a cap-removing section coaxially depending from said grasping section and having an outwardly and downwardly tapering inner circumferential wall, said cap-removing section having a continuously varying diameter greater than said first diameter and corresponding to a range of bottle cap sizes, the inner walls of said cap-removing section including a plurality of axial splines or ribs which are tapered to a greater degree than the wall of said cap-removing section, said splines or ribs having a cross-section that varies from a vee-shaped form at the largest-diameter portion of said cap-removing section to a half-round or semi-circular form at the smallest-diameter portion of said cap-removing section for mechanically engaging the peripheries of said range of bottle caps.

8. The bottle cap remover of claim 7, in which said grasping portion includes a plurality of arcuate recesses formed about its periphery for receiving a user's fingers.

9. The bottle cap remover of claim 8, in which a plurality of peripheral segments are defined intermediate said arcuate recesses of said grasping portion, and wherein a slot of rectangular cross-section is formed in at least one of said peripheral segments for engaging the closure tab of a can, said slot including a tapered wall to mechanically aid in the lifting of the closure tab.

10. The bottle cap remover of claim 7, in which said plurality of tapered vee-shaped splines or ribs are joined in a colinear form and wherein said plurality of splines or ribs which are half-round or semi-circular are joined to said vee-shaped splines in the form of a partial dome.

11. A bottle cap remover comprising an upper grasping portion having a first diameter, a first cap-removing section coaxially depending from said grasping portion and having a second diameter less than said first diameter, said second diameter corresponding to the diameter of a first-sized bottle cap, and a second cap-removing section depending coaxially from said first cap-removing section and having a third outwardly tapering diameter greater at its smallest diameter segment than said second diameter, said tapering diameter corresponding to the diameters of a variety of different-sized bottle caps each of a greater diameter than said first-sized bottle cap, said first and second cap-removing sections including a first and second plurality of splines or ribs circumferentially respectively spaced along their inner walls, said first and second plurality of splines or ribs having respectively different cross-sections and respectively spaced circumferentially from one another by a distance corresponding to the spacing between the recessed segments formed about the peripheries of said first-sized and different-sized bottle caps for respectively mechanically engaging the peripheries of said bottle caps.

12. The bottle cap remover of claim 11, in which said first plurality of splines or ribs are tapered and are half-round or semi-circular in cross-section and said second plurality of splines or ribs are vee-shaped in cross-section.

* * * * *